US006827410B2

(12) United States Patent
Antos et al.

(10) Patent No.: US 6,827,410 B2
(45) Date of Patent: Dec. 7, 2004

(54) REFRIGERATOR DOOR ASSEMBLY AND METHOD OF MAKING SAME

(75) Inventors: John M. Antos, Ann Arbor, MI (US); James C. Butler, Sidney, OH (US)

(73) Assignee: Thetford Corporation, Ann Arbor, MI (US)

( * ) Notice: Subject to any disclaimer, the term of this patent is extended or adjusted under 35 U.S.C. 154(b) by 31 days.

(21) Appl. No.: 10/225,661

(22) Filed: Aug. 22, 2002

(65) Prior Publication Data

US 2003/0038139 A1 Feb. 27, 2003

Related U.S. Application Data

(60) Provisional application No. 60/314,984, filed on Aug. 24, 2001.

(51) Int. Cl.[7] ..... A47F 3/04
(52) U.S. Cl. ..... 312/405; 312/236
(58) Field of Search ..... 312/223.1, 236, 312/405, 297

(56) References Cited

U.S. PATENT DOCUMENTS

| | | | | | |
|---|---|---|---|---|---|
| 2,596,706 | A | | 5/1952 | McClure | 312/329 |
| 3,584,927 | A | * | 6/1971 | Ott et al. | 250/458.1 |
| 4,075,798 | A | * | 2/1978 | Tazaki | 52/168 |
| 4,583,796 | A | | 4/1986 | Nakajima et al. | 312/214 |
| 5,946,929 | A | | 9/1999 | Selina et al. | 62/263 |
| D420,015 | S | * | 2/2000 | DeBoer | D15/89 |
| 6,166,353 | A | * | 12/2000 | Senneville et al. | 219/385 |
| 6,212,902 | B1 | | 4/2001 | Leistner | 62/497 |
| D452,971 | S | * | 1/2002 | Funabasama et al. | D15/81 |
| 6,338,536 | B1 | * | 1/2002 | Ueno et al. | 312/405 |
| D461,482 | S | | 8/2002 | Wissinger et al. | D15/91 |
| D462,976 | S | * | 9/2002 | Selina et al. | D15/91 |
| 6,648,637 | B2 | * | 11/2003 | Quigley | 432/242 |

FOREIGN PATENT DOCUMENTS

| | | | |
|---|---|---|---|
| GB | 2 052 249 | | 1/1981 |
| GB | 2 222 650 | * | 3/1990 |

* cited by examiner

*Primary Examiner*—Janet M. Wilkens
(74) *Attorney, Agent, or Firm*—Harness, Dickey & Pierce, P.L.C.

(57) ABSTRACT

A door assembly for a refrigerator having a cabinet with a cabinet opening, a cabinet height and a cabinet width includes a main body portion and a cap portion. The main body portion has a door height and a door width generally corresponding in size to the cabinet height and the cabinet width, respectively. The cap portion is secured to and upwardly extends from the main body portion. The cap is configured to substantially cover a plurality of control elements upwardly extending from the cabinet when the door assembly is articulated to a closed position.

21 Claims, 5 Drawing Sheets

REFRIGERATOR DOOR ASSEMBLY AND METHOD OF MAKING SAME

CROSS-REFERENCE TO RELATED APPLICATION

This application is based on provisional patent application which has been assigned U.S. Ser. No. 60/314,984, filed Aug. 24, 2001.

FIELD OF THE INVENTION

The present invention generally relates to refrigerators. More particularly, the present invention relates to a refrigerator door assembly and a method of making same. In one particular form, the present invention relates to a cap portion of a door assembly that upwardly extends from a main body portion to conceal and protect controls mounted to an upper surface of a cabinet when the door assembly is articulated to a closed position.

BACKGROUND OF THE INVENTION

Vehicles including but not limited to recreational vehicles ("RVs" in the United States and "Caravans" in Europe), tractor trailers, airplanes, boats, trains, and the like often incorporate refrigerators for the comfort and convenience of the occupants. Space available for refrigerators on such vehicles is limited and a significant design emphasis has been placed upon maximizing refrigerator storage volume. In a manner well known in the art, refrigerator controls typically upwardly extend from the cabinet so as not to limit storage volume.

While such conventional arrangements that include controls upwardly extending from a cabinet have proven to be optimal for various applications, they are all associated with limitations. For example, controls that visibly extend above a door of the refrigerator often present an undesirable appearance when the door is closed. In addition, the lighted elements of conventional refrigerator controls are the source of complaints from some vehicle operators when incorporated into a sleeping environment such as that of an RV or the like. Furthermore, controls that upwardly extend from a refrigerator cabinet are subject to inadvertent operation.

Accordingly, it remains a need in the pertinent art to provide a refrigerator door assembly that overcomes the limitations associated with the prior known arrangements, including but not limited to those disadvantages discussed above.

SUMMARY OF THE INVENTION

It is a general object of the present invention to provide a door assembly for a refrigerator which includes an upper cap portion for concealing a plurality of control elements that upwardly extend from a cabinet when the door assembly is articulated to a closed position.

In one particular form, the present invention provides a door assembly for a refrigerator. The door assembly selectively closes an opening of a cabinet. The cabinet has a cabinet height and a cabinet width. The door assembly includes a main body portion and a cap portion. The main body portion has a door height and a door width generally corresponding in size to the cabinet height and the cabinet width, respectively. The cap portion is secured to and upwardly extends from the main body portion. The cap portion is configured to substantially cover a plurality of control elements upwardly extending from the cabinet when the door assembly is articulated to a closed position.

In another form, the present invention provides a method of making a refrigerator. The method includes the general steps of:

providing a cabinet having a opening, a cabinet height and a cabinet width;

securing a plurality of control elements to the cabinet such that the plurality of control elements upwardly extend from the cabinet;

pivotally securing a main body portion of a door assembly to the cabinet, the main body portion having a door height and a door width generally corresponding in size to the cabinet height and cabinet width, respectively;

forming a cap portion of the door assembly; and securing the cap portion to the main body portion such that the cap portion substantially conceals the plurality of control elements when the main body portion is articulated to a closed position.

In yet another particular form, the present invention provides a refrigerator including a cabinet, a plurality of refrigerator controls and a door assembly. The cabinet defines a door opening and includes a cabinet height and a cabinet width. The refrigerator controls are mounted to and extend upwardly from the cabinet. The door assembly is pivotally attached to the cabinet for selectively opening and closing the door opening. The door assembly includes a main body portion and a cap portion. The main body portion has a door height and a door width generally corresponding in size to the cabinet height and the cabinet width, respectively. The cap portion is secured to and upwardly extends from the main body portion. The cap portion is configured to substantially cover the plurality of control elements when the door assembly is articulated to the closed position.

Additional advantages and features of the present invention will become apparent from the following description and appended claims, taken in conjunction with the accompanying drawings.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

The following description of the preferred apparatus and method of the present invention is merely exemplary in nature and is in no way intended to limit the invention, its application, or uses.

Figure 1A:
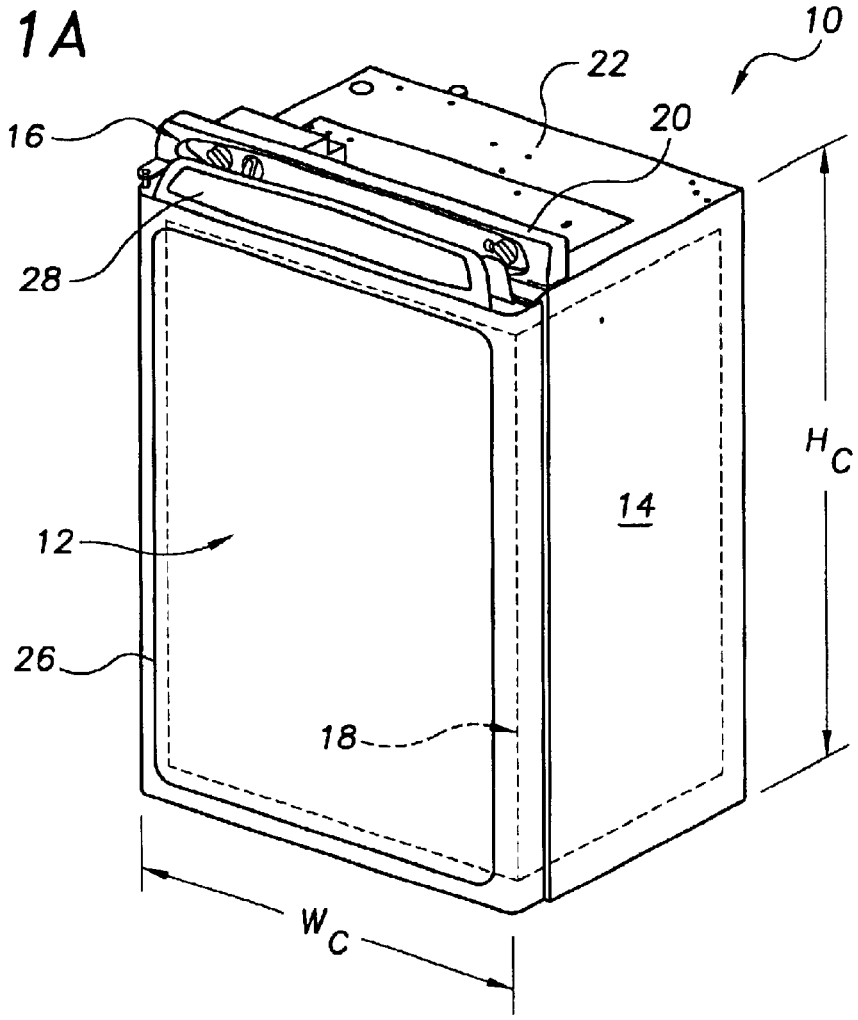
FIG. 1A is a perspective view of a refrigerator incorporating a door assembly constructed according to the teachings of a preferred embodiment of the present invention.
Figure 1B:
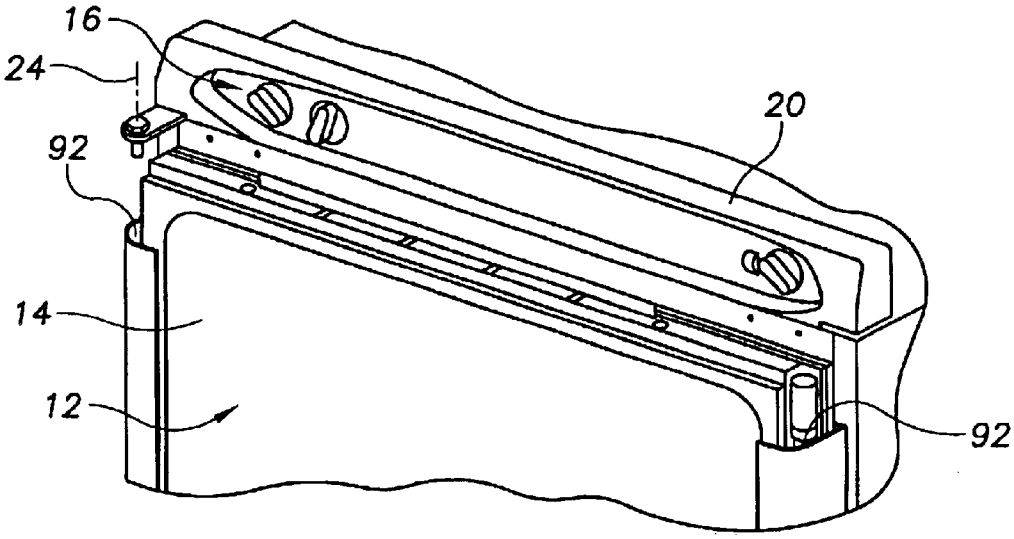
FIG. 1B is a perspective view of a portion of the refrigerator of FIG. 1A illustrated with an upper portion of the door assembly removed for purposes of illustration.
Figure 2:
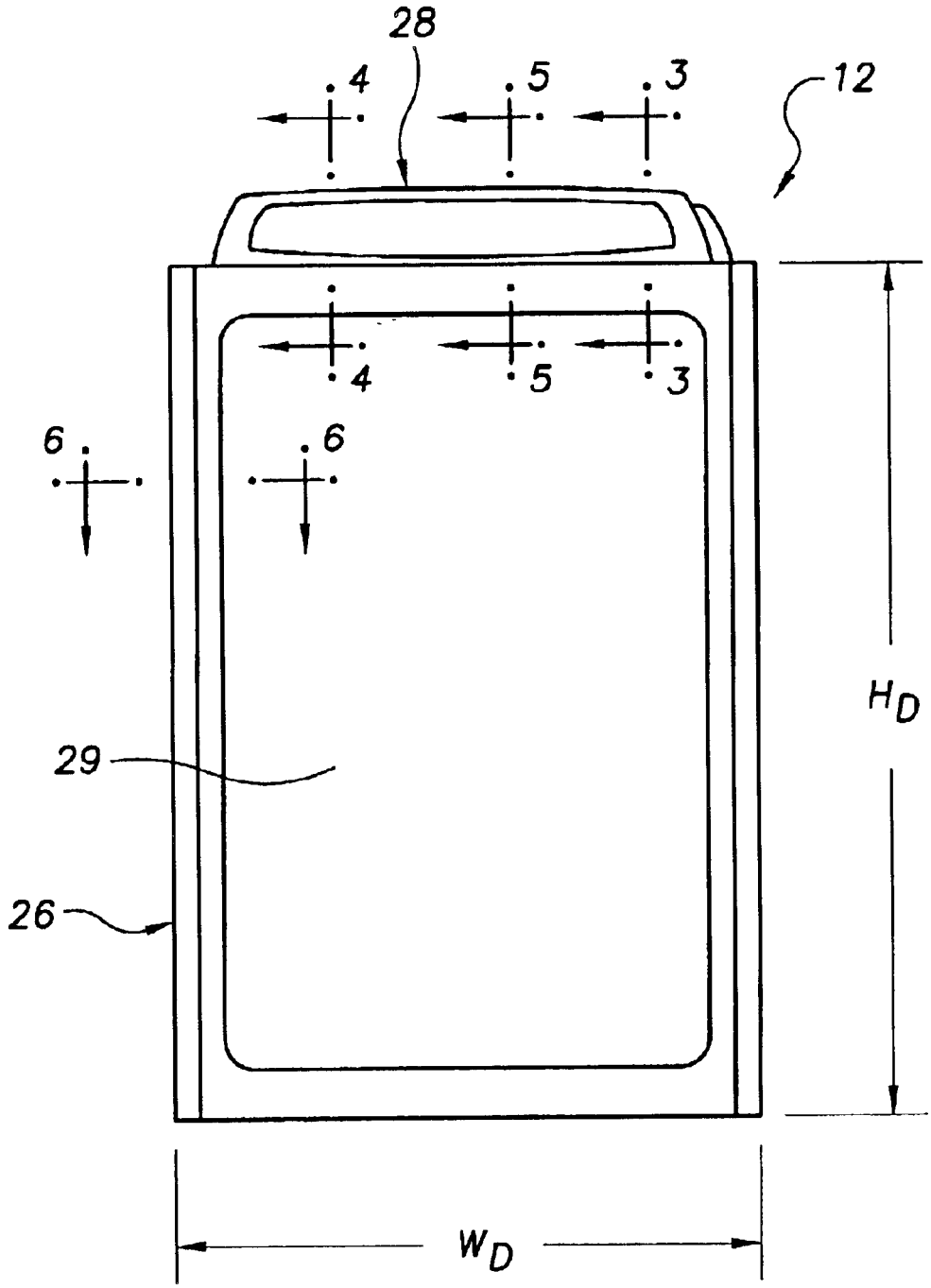
FIG. 2 is an enlarged front view of the door assembly according to the teachings of the preferred embodiment of the present invention.

With initial reference to FIGS. 1A and 1B of the drawings, a refrigerator embodying the teachings of a preferred embodiment of the present invention is illustrated and generally identified at reference character 10. The refrigerator is illustrated to generally include a door assembly 12, a cabinet 14, and a plurality of refrigerator controls 16. As will become apparent below, the subject invention is particularly directed to certain aspects of the door assembly 12 and a related method of manufacture. However, prior to describing the door assembly 12 and its manner of manufacture, a brief understanding of the remainder of the exemplary refrigerator 10 shown in the drawings is warranted.

The cabinet 14 defines a door opening 18 (shown in FIG. 1 in hidden lines) for providing access to one or more storage compartments (not specifically shown). The cabinet 14 includes a cabinet height $H_C$ and a cabinet width $W_C$. In the particular embodiment illustrated, the cabinet height $H_C$ is greater than the cabinet width $W_C$. However, it will be clearly understood that the teachings of the present invention are not restricted to any particular dimensions or relative dimensions.

The refrigerator 10 includes a control panel 20 which carries the plurality of refrigerator controls 16. The control panel 20 upwardly extends from the cabinet 14 and is secured to the cabinet 14 with fasteners or in any other manner well known in the art. In a conventional manner, wiring (not shown) for the plurality of control 16 extends across an upper surface 22 of the cabinet and down the backside of the cabinet 14.

With continued reference to FIGS. 1A and 1B and additional reference to FIGS. 2–9, the door assembly 12 of the present invention will be further described. The door assembly 12 is mounted to the cabinet 14 for pivotal movement about an pivot axis 24 (identified in FIG. 1B). In the embodiment illustrated, the pivot axis 24 couples a left hand side of the cabinet 14 with a left hand side of the door assembly 12. Alternatively, the door assembly 12 may be mounted for articulation about a right hand pivot axis.

The door assembly 12 generally includes a main body portion 26 and a cap or upper portion 28. The main body portion 26 includes a door height $H_D$ and a door width $W_D$ generally corresponding in size to the cabinet height $H_C$ and the cabinet width $W_C$, respectively. The main body portion 26 further includes a first or exterior panel 29 and a second or interior panel 31. In a manner known in the art, a cavity between the exterior panel 29 and interior panel 31 is filled with insulation, such as a closed-cell foam.

In a manner to be discussed below, the cap portion 28 is secured to and upwardly extends from the main body portion 26 of the door assembly 12. The cap portion 28 functions to substantially conceal the plurality of controls 16 when the door assembly 12 is articulated to its closed position (as shown in FIG. 1A) but maintains a small access for fingers to open the door. This access is symmetrical to allow for right-hand or left-hand hinging of the door assembly 12. Typically, refrigerators of the type to which the subject invention is directed are installed immediately adjacent other cabinets having front faces that extend to the front of the door assembly 12 or underneath counters which extend forward the same amount. The plurality of controls 16 is readily accessible when the door assembly 12 is articulated to its open position (not particularly shown).

In the embodiment illustrated, the cap portion 28 is illustrated to include a first member 30 and a second member 32. The first member 30 includes an upper portion having a front surface 34 and a rear surface 36. In a laterally positioned central section, the front and rear surfaces 34 and 36 are spaced apart so as to define a cavity 38 (shown particularly in FIG. 5). The front surface 34 is shown to include a recessed ornamental portion.

A lower portion of the first member 30 includes a downwardly extending forward flange 42 and a pair of downwardly extending rearward flanges 44 and 46. The lower portion is open between the forward flange 42 and the adjacent rearward flange 44. In the preferred embodiment, the first member 30 is injection molded of a plastic material. The space between the flanges 42 and 44 provides injection molding access to the cavity 38.

The second member 32 is preferably injection molded of a plastic and includes a horizontally extending central portion 48, a downwardly extending forward flange 50, a downwardly extending rearward flange 52 and an upwardly extending flange 54. The upwardly extending flange 54 is positioned slightly forward from the downwardly extending rearward flange 52. A forwardly extending segment 56 depends from the downwardly extending forward flange 54.

Figure 3:
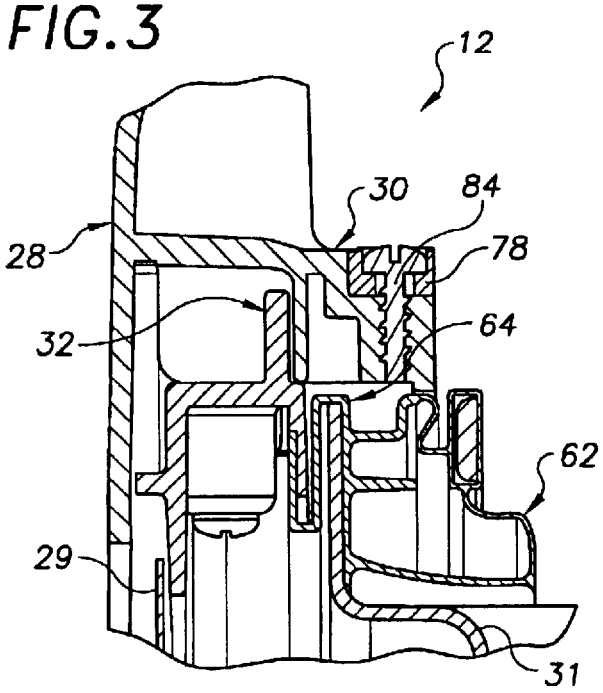
FIG. 3 is a cross-sectional view taken along the line 3—3 of FIG. 2.
Figure 5:
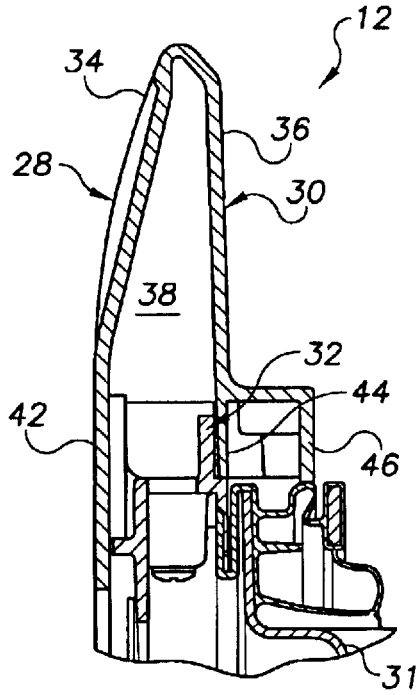
FIG. 5 is a cross-sectional view taken along the line 5—5 of FIG. 2.
Figure 4:
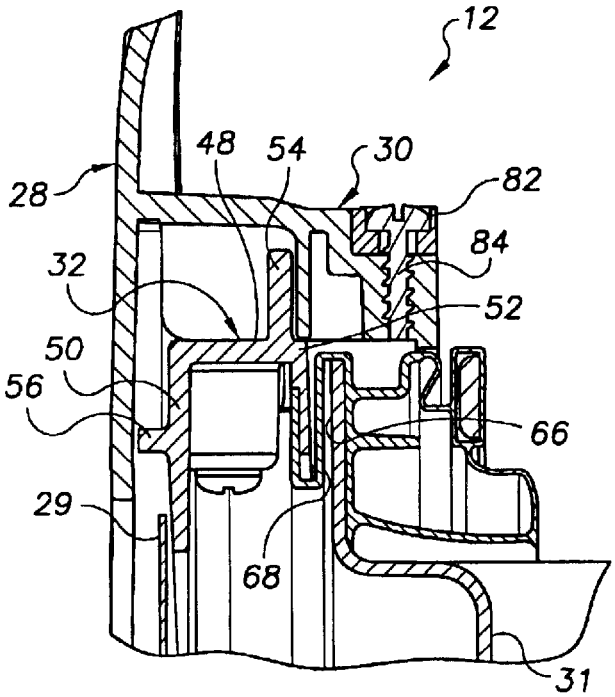
FIG. 4 is a cross-sectional view taken along the line 4—4 of FIG. 2.
Figure 6:
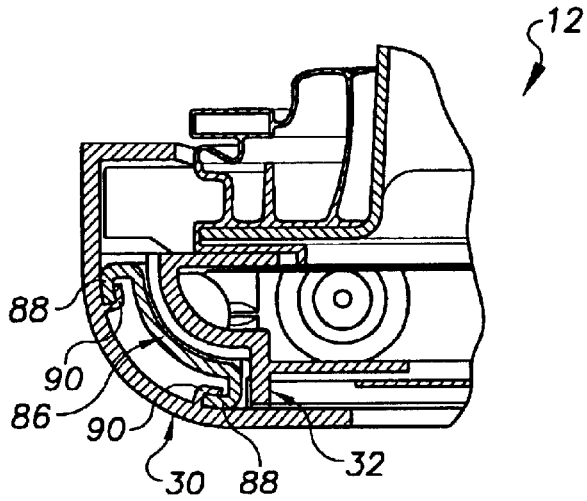
FIG. 6 is a cross-sectional view taken along the line 6—6 of FIG. 2.
Figure 7:
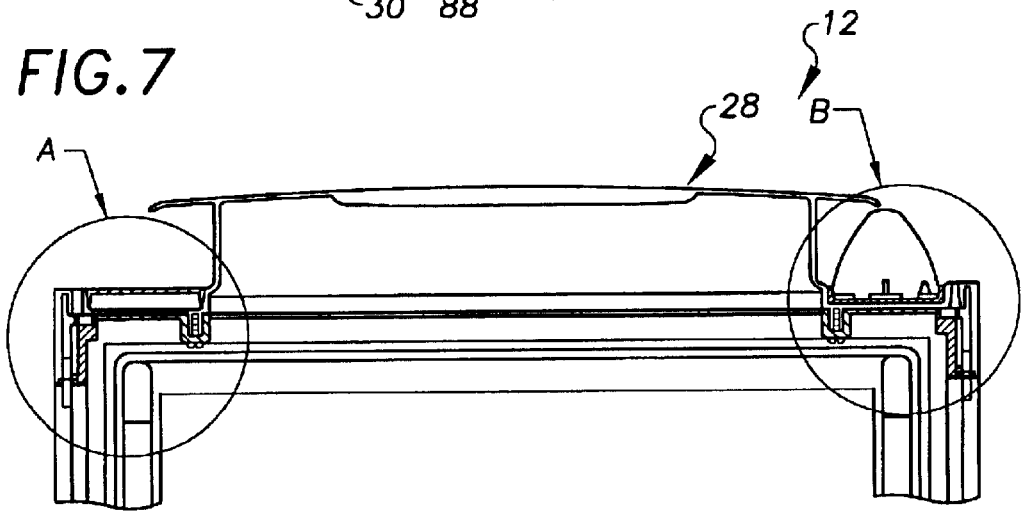
FIG. 7 is a lateral cross-sectional view taken through the upper portion of the door assembly of the present invention.
Figure 8:
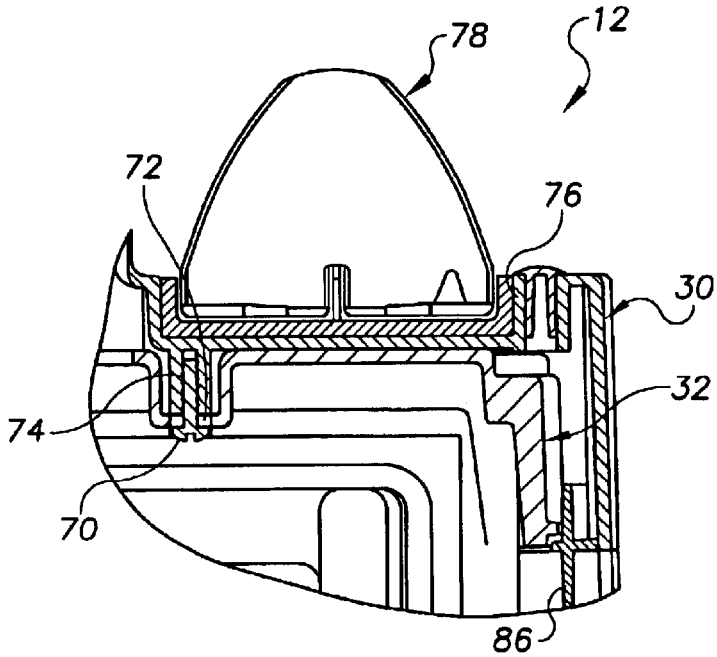
FIG. 8 is an enlarged view of the detail of circle A of FIG. 7.
Figure 9:
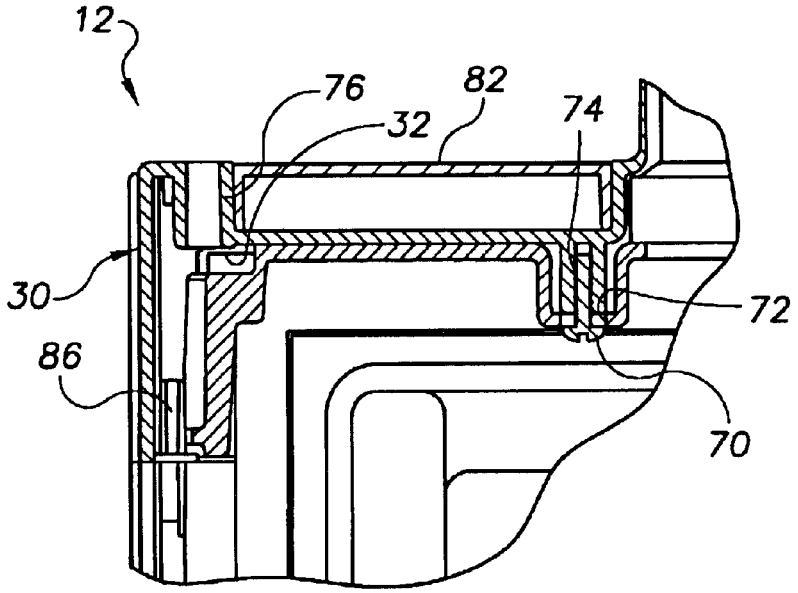
FIG. 9 is an enlarged view of the detail of circle B of FIG. 7.

As most particularly shown in the cross-sectional views of FIGS. 3 through 5, the second member 32 is received by the first member 30 in a vertical direction. A slot or channel for receiving the exterior panel 29 is defined by the downwardly extending leg 42, the downwardly extending leg 50 and the forwardly extending segment 56.

The interior panel 31 is secured to the cap portion 28 through a door seal 62. In this regard, the door seal 62 includes a S-shaped mounting portion 64. An upwardly facing opening 66 of the mounting portion 64 receives the downwardly extending flange 52. A downwardly facing opening 68 of the mounting portion 64 receives the interior panel 31.

The second member 32 is secured to the first member 30 with multiple threaded fasteners 70. The threaded fasteners 70 pass through apertures 72 provided in the second member 32 and threadably engage internal threaded boss portions 74 of the first member 30. This arrangement is shown particularly in the cross-sectional views of FIGS. 8 and 9.

The first member 30 is preferably shown to include a recess 76 (see FIGS. 8 and 9) for receiving a handle 78. It will be understood that the handle 78 is beyond the scope of the present invention. As shown, the handle 78 is mounted to the right hand side of the door assembly 12. A cover plate 82 is disposed in the recess 76 on the left side. Where it is desired to mount the door assembly 12 to the cabinet 14 such that the door assembly 12 articulates about a right hand axis, the plate 82 and the handle 78 can be interchanged. The plate 82 and the handle 78 are secured to the first member 30 with threaded fasteners 84 (see FIGS. 3 and 4).

Figure 10:
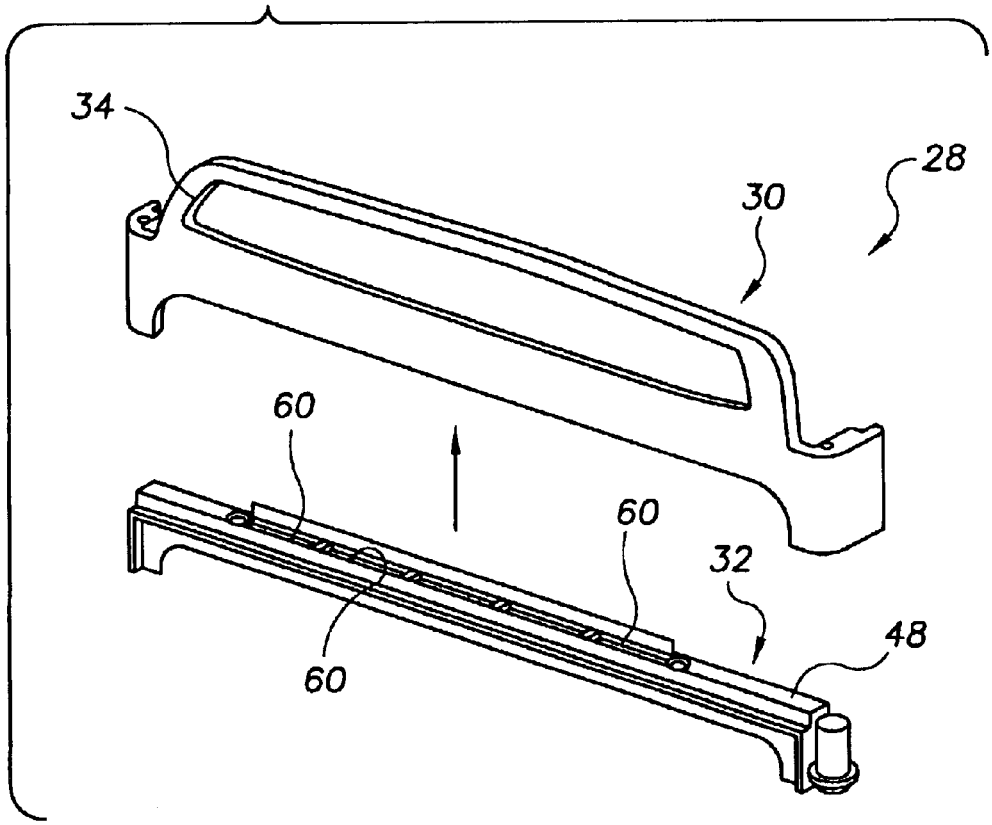
FIG. 10 is an exploded perspective view of an upper portion of the door assembly.

The horizontally extending portion 48 is shown in FIG. 10 to include a plurality of slots 60. When the foam is injected into the space between the exterior and interior panels 29 and 31 of the door assembly 12, the slots 60 permit the foam to flow into the cavity 38.

Prior to the introduction of foam into the door assembly 12, the cap portion 28 is positioned relative to the main body portion 26 through a pair of clips 86. The clips 86 are shown in the cross-sectional view of FIG. 6 to be generally C-shaped. The open ends 88 of each clip 86 engage L-shaped projections 90 that inwardly extend from the first member 30. The clips 86 downwardly extend into channels 92 (see FIG. 1B) defined by the frame of the main body portion 14. After the door assembly 12 is filled with foam, the clips 86 are no longer needed to maintain the relative position between the cap portion 28 and the main body portion 26.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A door assembly adapted for use on a refrigerator, the refrigerator having a cabinet with a cabinet opening, a cabinet height and a cabinet width, the door assembly for selectively closing the cabinet opening, the door assembly comprising:

a main body portion having a door height and a door width configured to generally correspond in size to the cabinet height and the cabinet width, respectively; and a cap portion secured to and upwardly extending from the main body portion, the cap portion configured to extend above the cabinet along a substantial portion of the width of the cabinet to substantially cover a plurality of control elements upwardly extending from the cabinet when the door assembly is articulated to a closed position.

2. The door assembly for a refrigerator of claim 1, wherein the cap portion defines a hollow cavity.

3. The door assembly for a refrigerator of claim 2, wherein the hollow cavity is filled with a foam.

4. The door assembly for a refrigerator of claim 2, wherein the cap portion includes a first member and a second member, the first member defining the hollow cavity, the second member cooperating with the first member to define first and second laterally extending grooves for receiving an interior panel and an exterior panel of the main body portion, respectively.

5. The door assembly for a refrigerator of claim 4, wherein the cap portion is injection molded.

6. The door assembly for a refrigerator of claim 1, wherein the main body portion includes an interior panel and an exterior panel and wherein the cap portion defines first and second laterally extending grooves for receiving the interior and exterior panels, respectively.

7. The door assembly for a refrigerator of claim 6, wherein the cap portion is injection molded.

8. The door assembly of claim 1 in combination with the refrigerator.

9. The door assembly of claim 1, further comprising a handle carried by the main body portion, the handle disposed behind the cap portion.

10. A method of making a refrigerator, the method comprising:

providing a cabinet having an opening, a cabinet height and a cabinet width;

securing a plurality of control elements to the cabinet such that the plurality of control elements upwardly extend from the cabinet;

pivotally securing a main body portion of a door assembly to the cabinet, the main body portion having a door height and door width generally corresponding in size to the cabinet height and cabinet width, respectively;

forming a cap portion of the door assembly; and securing the cap portion to the main body portion such that the cap portion extends above the cabinet along a substantial portion of the width of the cabinet and substantially conceals the plurality of controls elements when the main body portion is articulated to a closed position.

11. The method of making a door assembly for a refrigerator of claim 10, wherein the step of forming a cap portion includes the step of defining a hollow cavity.

12. The method of making a door assembly for a refrigerator of claim 9, wherein the main body portion includes an interior panel and an exterior panel and wherein the step of forming a cap portion includes the steps of defining first and second laterally extending grooves for receiving the interior and exterior panels, respectively.

13. The method of making a door assembly for a refrigerator of claim 10, wherein the step of forming the cap portion includes the step of:

injection molding a first member defining the hollow cavity; and injection molding a second member which cooperates with the first member to define the first the second laterally extending grooves for receiving an interior panel and the exterior panel of the main body portion, respectively.

14. The method of making a door assembly for a refrigerator of claim 9, further including the step of filling the hollow cavity with a foam.

15. The method of making a door assembly for a refrigerator of claim 10, wherein the step of forming the cap portion includes the step of injection molding the cap portion.

16. A refrigerator comprising:

a cabinet having a door opening, a cabinet height and a cabinet width;

a plurality of refrigerator controls attached to and upwardly extending from the cabinet; and a door assembly pivotally attached to the cabinet for selectively opening and closing the door opening, the door assembly including a main body portion and cap portion, the main body portion having a door height and door width generally corresponding in size to the cabinet height and the cabinet width, respectively, the cap portion secured to and upwardly extending from the main body portion above the cabinet along a substantial portion of the width of the cabinet, the cap portion configured to substantially cover the plurality of control elements when the door assembly is articulated to a closed position.

17. The refrigerator of claim 16, wherein the cap portion defines a hollow cavity.

18. The refrigerator of claim 17, wherein the cap portion is injection molded.

19. The refrigerator of claim 17, wherein the hollow cavity is filled with a foam.

20. The refrigerator of claim 17, wherein the cap portion includes a first member and a second member, the first member defining the hollow cavity, the second member cooperating with the first member to define first and second laterally extending grooves for receiving an exterior panel and an exterior panel of the main body portion, respectively.

21. The refrigerator of claim 16, wherein the main body portion includes an interior panel and an exterior panel and wherein the cap portion defines first and second laterally extending grooves for receiving the interior and exterior panels, respectively.

* * * * *